US006430780B1

(12) United States Patent
Kim et al.

(10) Patent No.: US 6,430,780 B1
(45) Date of Patent: Aug. 13, 2002

(54) DOOR HANDLE INSTALLATION STRUCTURE OF REFRIGERATOR

(75) Inventors: Tae Young Kim; O Bong Choi, both of Changwon (KR)

(73) Assignee: LG Electronics Inc., Seoul (KR)

( * ) Notice: Subject to any disclaimer, the term of this patent is extended or adjusted under 35 U.S.C. 154(b) by 11 days.

(21) Appl. No.: 09/679,815

(22) Filed: Oct. 5, 2000

(30) Foreign Application Priority Data

Dec. 28, 1999 (KR) ..... 64171/1999
Dec. 28, 1999 (KR) ..... 64173/1999

(51) Int. Cl.[7] ..... A47B 95/02
(52) U.S. Cl. ..... 16/412; 16/436
(58) Field of Search ..... 16/412, 413, 436, 16/DIG. 24, DIG. 25, DIG. 19, 415, 419, 420, 422, 424, 443, 444; 312/244

(56) References Cited

U.S. PATENT DOCUMENTS 248,865 A * 11/1881 Leonard ..... 16/436
2,851,304 A * 9/1958 Timms ..... 16/436
3,995,349 A * 12/1976 Roberts et al. ..... 16/412
5,385,248 A * 1/1995 Klein, Jr. ..... 16/436
5,632,062 A * 5/1997 Katz et al. ..... 16/412
5,740,587 A * 4/1998 Onai et al. ..... 16/412
6,185,785 B1 * 2/2002 Kingston ..... 16/412

* cited by examiner

*Primary Examiner*—Lynne H. Browne
*Assistant Examiner*—Doug Hutton
(74) *Attorney, Agent, or Firm*—Birch, Stewart, Kolasch & Birch, LLP

(57) ABSTRACT

The present invention relates to a door handle installation structure of a refrigerator which is capable of installing a door handle more securely to a door of a refrigerator, separating the door handle freely from the door as occasion demands, repairing or replacing the door handle easily when they are damaged, comprising a door having an insulating layer formed inside and at least one combining hole at the front, a holder combined to the front surface of the door having at least one horizontal combining hole and a longitudinal combining hole, a door handle combined to the other side of the holder having a hollow area inside and at least one insertion hole punched on a side of the outer circumference toward the door, a holder combining mean for combining the door to the other side of the holder, and a door handle combining mean for combining the door handle to the other portion of the holder.

10 Claims, 3 Drawing Sheets

DOOR HANDLE INSTALLATION STRUCTURE OF REFRIGERATOR

BACKGROUND OF THE INVENTION

1. Field of the Invention

The present invention relates to a door handle installation structure of a refrigerator, and in particular to a door handle installation structure of a refrigerator which is capable of installing the door handle more securely to a door of the refrigerator.

2. Description of the Prior Art

In the conventional refrigerator, a door handle is installed on the front of a door for opening/closing selectively a cooling storage inside of the refrigerator.

As depicted in FIG. 1 and FIG. 2, a door handle 5 installed on a door 1 of the conventional refrigerator is formed as a bar shape having a long length in the comparison with a diameter, and is combined to the door 1 by a holder 7 placed between them.

Hereinafter, the conventional door handle installation structure of the refrigerator will now be described in more detail.

First, an insulating layer 2 is formed inside of the door 1, and a bracket 3 is combined between the inner side surface of the door 1 and the insulating layer 2.

The holder 7 placed outer surface of the door corresponding to the bracket 3 is fastened to the bracket 3 by a first fastening screw 4.

The door handle 5 placed outer surface of the holder 7 is combined to the holder 7 by a second fastening screw 8, accordingly the door handle 5 is installed on the door 1.

A non-described reference numeral 6 is a filling member for shielding inner hollow area of the door handle 5, and fastening the second fastening screw 8 more securely to the door handle 5 by being filled the inner hollow area of the door handle 5.

Above-described combining structure is for the upper part structure of the door handle 5, the lower part structure of the door handle is not depicted, because it has a same structure with the upper part.

In the conventional door handle installation structure of the refrigerator, the installation operation for installing the door handle 5 to the door 1 will now be described.

First, the door handle 5 and holder 7 are fastened by the second fastening screw 8.

When the bracket 3 is placed inner surface of the door 1 before the insulating layer 2 is formed, the first fastening screw 4 fastens the holder 7 to the front surface of the door by penetrating the bracket 3 from the inside of the door 1, and the insulating layer 2 is formed inside of the door 1.

After forming the insulating layer 2, a foaming agent is sprayed inside of the door 1 and is hardened, accordingly the installation of the door handle of the refrigerator is accomplished.

However, the conventional door handle installation structure of the refrigerator has below problems.

First, in the conventional technology the forming structure of the insulating layer is complicated because the insulating layer is formed inside of the door after combining the door handle to the door, and the shape of the door can be distorted due to the insulating layer forming process.

In other words, in order to form the insulating layer, an additional complicated breach for placing the door handle has to formed on a door foaming jig supporting the door, accordingly the shape of the door foaming jig is complicated.

In addition, the surface of the door contacted to the door handle can be uneven and protruded after forming the insulating layer because the surface of the door corresponding to the door handle is not directly supported by the door foaming jig.

In addition, the bracket and fastening screw are fixed while the insulating layer is formed after the door handle is combined to the door, herein the door handle may droop due to a self weight, accordingly the door handle, holder and door can not be closely adhered accurately, or even break away from the accurate position.

Most of all, as described above the door handle can not be disassembled after the fabrication unless the insulating layer is removed, accordingly it is impossible to change or repair the door handle separately.

SUMMARY OF THE INVENTION

The object of the present invention is to provide a door handle installation structure of a refrigerator which is capable of assembling easily.

The other object of the present invention is to provide a door handle installation structure of a refrigerator which is capable of disassembling the door handle easily after combining it to the door, and repairing the door handle separately.

The other object of the present invention is to provide a door handle installation structure of a refrigerator which is capable of combining the door handle on an accurate place.

In order to achieve the above described objects of the present invention, a door handle installation structure according to the present invention comprises a door having an insulating layer formed inside and at least one combining hole at the front, a holder combined to the front surface of the door having at least one horizontal combining hole and a longitudinal combining hole, a door handle combined to the other side of the holder having a hollow area inside and at least one insertion hole punched on a certain portion of the outer circumference toward the door, a holder combining mean for combining the door to a side of the holder, and a door handle combining mean for combining the door handle to the other side of the holder.

Accordingly, the present invention is capable of installing the door handle more securely to the door of the refrigerator at the accurate place, separating the door handle freely from the door as occasion demands, repairing or replacing the door handle easily when they are damaged, and fabricating the door more accurately by preventing uneven surface problem of the door.

DETAILED DESCRIPTION OF THE PREFERRED EMBODIMENTS

The embodiments of a door handle installation structure of a refrigerator according to the present invention will now be described in detail with reference to the accompanying drawings.

The door handle installation structure of the refrigerator according to the present invention comprises a door, a door handle, a holder for connecting the door and door handle, a holder combining mean, and a door handle combining mean.

Figure 1:
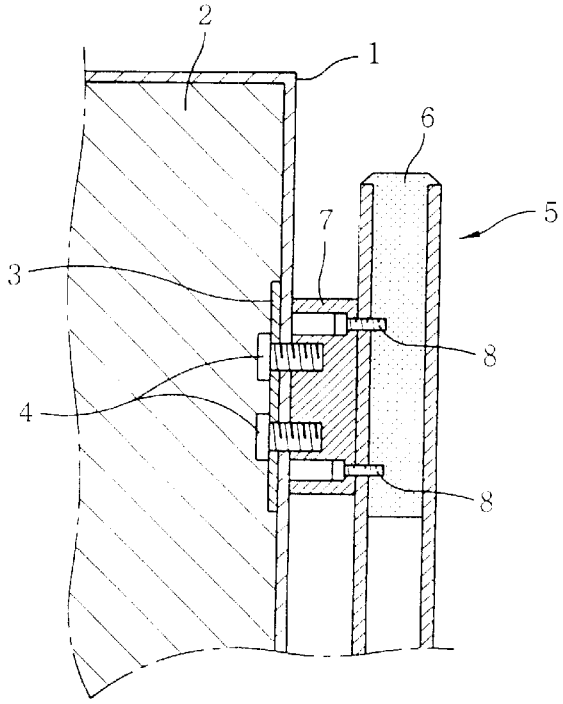
FIG 1 PRIOR ART
FIG. 1 sectional view illustrating the conventional door handle installation structure of a refrigerator.
Figure 2:
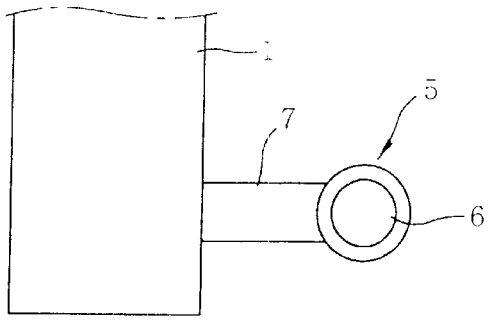
FIG 2 PRIOR ART
FIG. 2 is a plan view illustrating the conventional door handle installation structure of a refrigerator.
Figure 3:
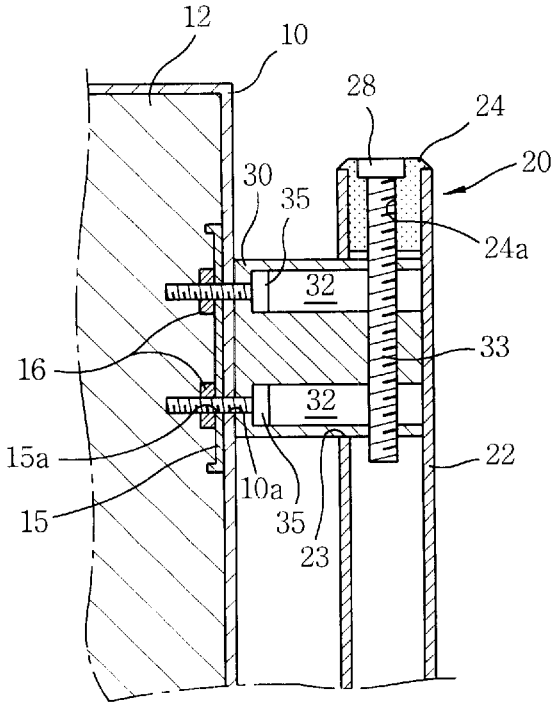
FIG. 3 is a sectional view illustrating a door handle installation structure of a refrigerator according to the embodiment of the present invention.
Figure 5:
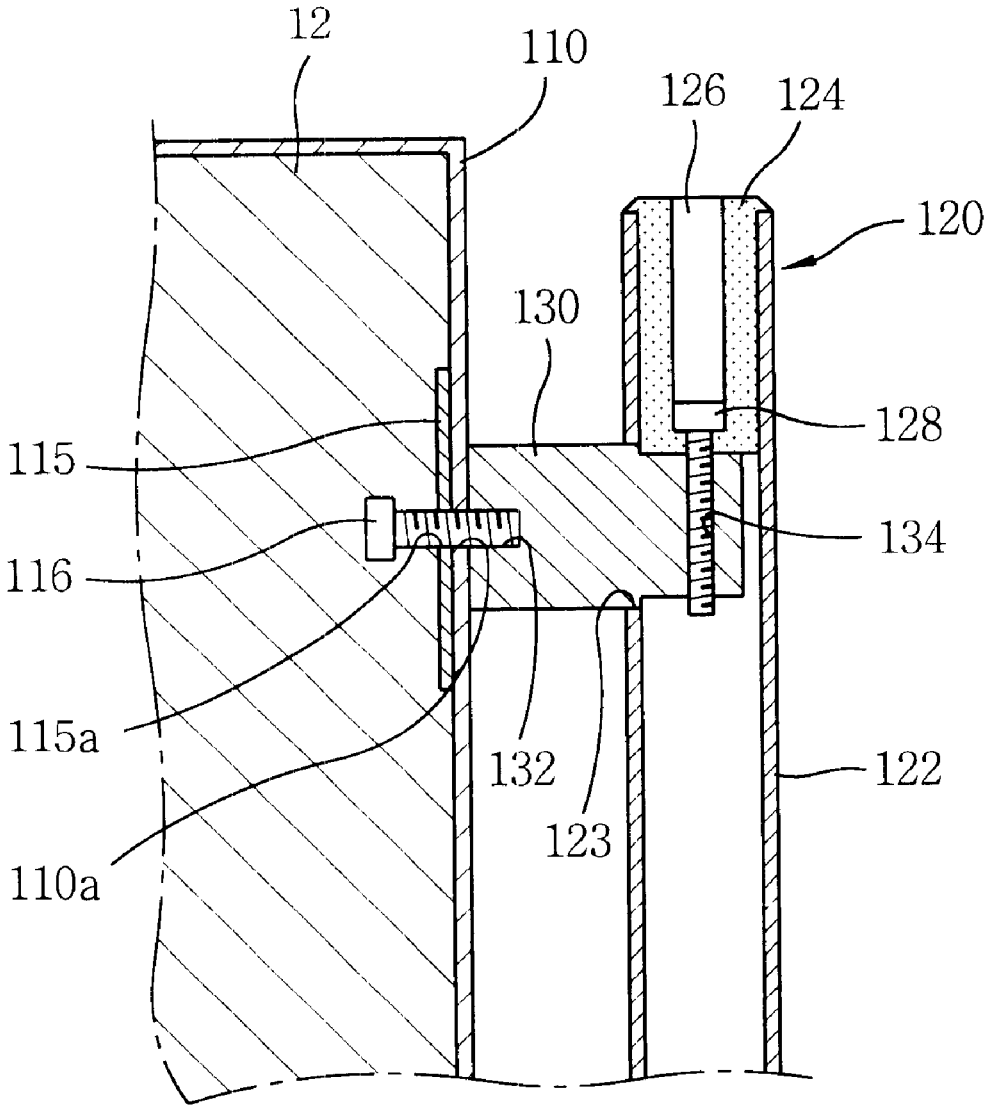
FIG. 5 is a sectional view illustrating a door handle installation structure of a refrigerator according to the other embodiment of the present invention.

In the door handle installation structure of the refrigerator according to the present invention, the construction of the upper part is same with the construction of the lower part as a line symmetry figure centering around the center part, accordingly the construction of the upper part as depicted in FIG. 3 and FIG. 5 will now be described, and a description for the construction of the lower part will be abridged.

Hereinafter, the embodiment of the door handle installation structure of the refrigerator will now be described in detail.

Figure 4:
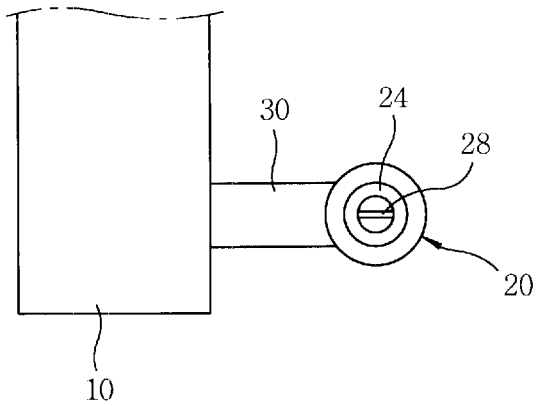
FIG. 4 a plan view illustrating a door handle installation structure of a refrigerator according to the embodiment of the present invention.

First, as depicted in FIG. 3 and FIG. 4, an insulating layer 12 is formed inside of the door 10, and a bracket 15 is combined between the inner surface of the door and insulating layer 15.

Herein, a plurality of first combining holes 10*a* are formed with a certain interval so as to penetrate from the inner and to the front surface of the door 10.

And, a plurality of second combining holes 15*a* are formed with a certain interval so as to communicate with the plurality of the first combining holes 10*a*.

And, each fastening nut 16 is placed between the bracket 15 and insulating layer 12 so as to communicate with the second combining hole 15*a*, the each fastening nut 16 is fixedly combined to the bracket 15 by using a welding method.

Second, the door handle 20 includes a door handle body unit 22 and a deco cap 24, the door handle body unit 22 is fabricated so as to have a hollow bar shape having a long length, and the deco cap 24 is fixedly inserted into the upper portion of the door handle body unit 22.

A plurality of insertion holes 23 are punched with a certain interval on a certain portion of the outer circumference of the door handle body unit 22 toward the door 10.

Meanwhile, the deco cap 24 covers the end portion of the door handle body unit 22, a fastening screw 28 is fastened to the vertical direction of the door handle body unit 22 and is placed inside of the door handle body unit 22.

As depicted in FIG. 3, the deco cap 24 is inserted from the upper portion to the inside of the door handle body unit 22, a third combining hole 24*a* is longitudinally formed inside of the deco cap 24 for insertion of the fastening screw 28.

In other words, the deco cap 24 is inserted inside of the door handle body unit 22, the lower portion of the deco cap 24 is placed so as to contact to the holder 30.

Third, the construction of the holder for combining the door handle 20 to the door 10 will now be described.

First, the holder 30 is placed between the door 10 and door handle 20, a plurality of horizontal combing holes 32 are formed inside of the holder 30, and a longitudinal combining hole 33 is formed inside of the door handle body unit 22 so as to communicate upwardly-downwardly with a certain portion of the horizontal combining holes 32 in a combination to the door handle body unit 22.

Herein, the longitudinal combining hole 33 is placed so as to communicate and be concentric with the third combining hole 24*a*.

The combining of the door handle installation structure of the refrigerator according to the embodiment of the present invention will now be described.

First, when the bracket 15 is fixed on the inner surface of the door 10 by the fastening nut 16, the door 10 is placed on a door foaming jig (not shown).

A foaming agent is sprayed inside of the door 10 in order to form the insulating layer 12.

The foaming agent is hardened and is formed the insulating layer 12.

The fastening bolts 35 are separately inserted into the plurality of the horizontal combining holes 32, the fastening bolts 35 are separately inserted into the combining nuts 16 fixed inside of the door 10 in order to combine a certain portion of the holder 30 to the door 10.

In other words, the certain portion of the holder 30 is combined to the door 10 by the holder combining mean such as the bracket 15, fastening nut 16 and fastening bolt 35.

And, the other portion of the holder 30 is inserted into the insertion hole 23 of the door handle body unit 22.

When the third combining hole 24*a* of the deco cap 24 communicates with the longitudinal combining hole 33 of the holder 30, the fastening screw 28 is inserted into the third combining hole 24*a* placed from the upper portion of the door handle body unit 22 to the inside of the door handle body unit 22 and longitudinal combining hole 33 of the holder 30 in order to combine the door handle 20 to the other portion of the holder 30.

In other words, the door handle 20 is combined to the other portion of the holder 30 by the door handle combining mean such as the deco cap 24, and the fastening screw 28.

Hereinafter, the other embodiment of the door handle installation structure of the refrigerator of the present invention will now be described in detail.

First, as depicted in FIG. 5, the insulating layer 12 is formed inside of a door 110, a bracket 115 is combined between the inner surface of the door and the insulating layer 12.

Herein, a first combining hole 110*a* is formed so as to penetrate the inner surface and front surface of the door 110.

And, a second combining hole 115*a* s formed on the bracket 115 so as to communicate with the first combining hole 110*a*.

A first fastening screw 116 is inserted into the second combining hole 115*a* of the bracket 115 in order to combine a certain portion of the holder 130 to the door 110, the first fastening screw 116 is extended from the inside of the door 100 toward the front surface of the door 110 and is protruded to the front surface of the door 110.

Second, the door handle 120 includes a door handle body unit 122 and a deco cap 124, the door handle body unit 122 is fabricated as a hollow bar shape having a long length, and the deco cap 124 is inserted into the upper portion of the door handle body unit 122.

An insertion hole 123 is punched on a certain portion of the outer circumference of the door handle body unit 122 toward the door 110 for insertion of the holder 130.

Meanwhile, the deco cap 124 covers the end portion of the door handle body unit 122, a second fastening screw 128 is combined to the upper end portion of the door handle body unit 122 to the vertical direction, and is placed inside of the door handle body unit 122.

And, as depicted in FIG. 5, the deco cap 124 is inserted into from the upper end portion to the inside of the door handle body unit 122, a third combining hole 126 is longitudinally formed inside of the deco cap 124 for insertion of the second fastening screw 128.

In other words, the deco cap 124 is inserted into the inside of the door handle body unit 122, the lower end portion of the deco cap 124 is placed so as to contact to the holder 130.

In the other embodiment of the present invention, the front end portion of the second fastening screw 128 is not placed on the same surface of the front end portion of the door handle body unit 122, but is placed inside of the door handle body unit 122.

Third, the construction of the holder 130 for combining the door handle 120 to the door 110 will now be described.

First, the holder 130 is placed between the door 110 and door handle 120, a horizontal combining hole 132 is formed inside of the holder 130 closely connected to the door 110, a longitudinal combining hole 133 is upwardly-downwardly formed on the portion inside of the door handle body unit 122 in the combination of the door handle body unit 122.

Herein, the longitudinal combining hole 133 is placed so as to communicate and be concentric with the third combining hole 126.

Hereinafter, the combination according to the other embodiment of the present invention will now be described.

When the bracket 115 is fixed on the inner surface of the door 110, the first fastening screw 116 is fixedly combined to the bracket 115, the end of the bracket 115 is placed so as to be protruded to the front surface of the door 110, and the door 110 is placed on the door foaming jig.

Herein, when the door foaming jig supports the door 110, a breach has to be formed on the door foaming jig in order to avoid a contact with the first fastening screw 116, in the other embodiment of the present invention the each first fastening screw 116 is placed on the upper and lower portion of the front surface of the door 110, accordingly forming the breach is easy in the other embodiment of the present invention.

When the door 110 is supported by the door foaming jig, the insulating layer 12 is formed inside of the door 110 by spraying the foaming agent.

The foaming agent is hardened and the insulating layer 12 is formed.

First, the first fastening screw 116 protruded to the front of the door 110 is combined to a certain portion of the holder 130.

In other words, the first fastening screw 116 fixedly combined to the door 110 is inserted into the horizontal combining hole 132 of the holder 130, and is fastened to the holder 130 by rotating the holder 130 a plurality of times.

In other words, the certain portion of the holder 130 is combined to the door 110 by the holder combining mean such as the bracket 115 and first fastening screw 116.

After that, the other portion of the holder 130 is inserted into the insertion hole 123 of the door handle body unit 122, the second fastening screw 128 is inserted into the third combining hole 126 of the deco cap 124 placed inside of the door handle body unit 122, the second fastening screw 128 is fixedly inserted into the longitudinal combining hole 134, and the holder 130 is combined to the door handle 120.

In other words, the door handle 20 is combined to the other portion of the holder 30 by the door handle combining mean such as the deco cap 124 and the second fastening screw 128.

Accordingly, in the embodiments of the present invention, load of the door handle 20, 120 is supported by the holder 30, 130, the door handle 20, 120 is supported by the holder 30, 130 by inserting the holder 30, 130 into the door handle body unit 22, 122 through the insertion hole 23, 123, the bottom surface of the deco cap 24, 124 is supported by the holder 30, 130, accordingly the door handle 20, 120 is securely installed on the door 10, 110.

As described above, in the door handle installation structure of the present invention, the door handle is combined to the door after forming the insulating layer inside of the door, accordingly the present invention is capable of separating the door handle freely from the door as occasion demands, repairing or changing the door handle easily.

In other words, the door handle can be separated from the holder by releasing the fastening screw of the deco cap, the holder can be separated from the door by releasing the fastening bolt, accordingly the door handle and holder can be easily replaced when they are damaged.

And, when the insulating layer is formed, the shape of the door foaming jig can be simplified because the shape of the door is simple, accordingly the insulating layer can be formed so as to be more secure and to support the overall surface of the door, thus it can prevent uneven surface problem of the door, and the size of the door can be fabricated more accurately.

In addition, the door handle can be combined more securely to the door because the door handle is combined to the door after the insulating layer of the door is perfectly hardened, accordingly the combining bolt is fastened more securely in a combination of the holder, and a chink between the holder and door can be prevented.

And, the door handle and holder can be assembled/disassembled outside of the door, accordingly when the door handle or door is damaged, the replacement or repair can be performed easily.

As the present invention may be embodied in several forms without departing from the spirit or essential characteristics thereof, it should also be understood that the above-described embodiments are not limited by any of the details of the foregoing description, unless otherwise specified, but rather should be constructed broadly within its sprit and scope as defined in the appended claims.

Therefore all changes and modifications that fall within the meets and bounds of the claims, or equivalence of such meets and bounds are therefore intended to be embraced by the appended claims.

What is claimed is:

1. A door handle installation structure of a refrigerator, comprising:

a door having an insulating layer formed inside and at least one combining hole at the front surface;

a holder combined to the front surface of the door having at least one horizontal combining hole and a longitudinal combining hole;

a door handle combined to the other side of the holder having a hollow area inside and at least one insertion hole punched on a certain portion of the outer circumference toward the door;

a holder combining mean for combining the door to a side of the holder; and a door handle combining mean for combining the door handle to the other side of the holder.

2. The door handle installation structure of the refrigerator according to claim 1, wherein the holder combining mean includes:

a bracket combined between the inner surface of the door and insulating layer having a plurality of combining holes;

a plurality of fastening nuts placed between the bracket and insulating layer combining separately to the bracket so as to communicate with the plurality of combining holes; and a plurality of fastening bolts inserted into the at least one horizontal combining hole and fastened separately to the fastening nuts.

3. The door handle installation structure of the refrigerator according to claim 2, wherein the plurality of fastening nuts are fixedly combined to the bracket by welding.

4. The door handle installation structure of the refrigerator according to claim 1, the longitudinal combining hole communicates with a certain portion of the horizontal combining hole.

5. The door handle installation structure of the refrigerator according to claim 1, wherein the door handle combining mean includes:

a deco cap fixedly inserted into the upper portion of the door handle having a combining hole inside; and a fastening screw fixedly inserted into the combining hole and longitudinal combining hole.

6. The door handle installation structure of the refrigerator according to claim 5, wherein the head portion of the fastening screw is placed on the same surface of a certain portion of the door handle.

7. The door handle installation structure of the refrigerator according to claim 5, wherein the head portion of the fastening screw is placed inside of the door handle.

8. The door handle installation structure of the refrigerator according to claim 5, wherein a certain end portion of the deco cap is placed so as to contact to the holder.

9. The door handle installation structure of the refrigerator according to claim 1, wherein the holder combining mean includes:

a bracket combined between the inner side surface of the door and insulating layer having a combining hole; and a fastening screw fixedly inserted into the combining hole of the bracket.

10. The door handle installation structure of the refrigerator according to claim 9, wherein the fastening screw is extended from the inside of the door toward the front surface of the door and is protruded to the front surface of the door, and a certain portion of the holder is combined to the protruded portion of the fastening screw.

* * * * *